United States Patent [19]

Voegeli

[11] 4,046,281

[45] Sept. 6, 1977

[54] METHOD AND APPARATUS FOR DISPENSING FLEXIBLE MATERIALS

[76] Inventor: Henry C. Voegeli, 918 Gibbs Rd., Venice, Fla. 33595

[22] Filed: Apr. 19, 1976

[21] Appl. No.: 677,866

[52] U.S. Cl. .....221/23; 221/48

[51] Int. Cl.[2] .....B65G 59/02

[58] Field of Search ....221/23, 45, 47, 48, 50, 51, 221/52, 63, 259, 260, 277

[56] References Cited

U.S. PATENT DOCUMENTS

| | | | |
|---|---|---|---|
| 2,082,765 | 6/1937 | Krueger | 222—52 X |
| 1,703,594 | 2/1929 | Pratt | 221—23 |
| 813,594 | 2/1906 | Sexton | 221—52 |
| 1,200,837 | 10/1916 | Hoberg | 221—259 X |

*Primary Examiner*—Stanley H. Tollberg
*Attorney, Agent or Firm*—Bacon and Thomas

[57] ABSTRACT

Method and apparatus are provided for dispensing individual sheets of flexible materials from an interleaved stack of folded sheets, whereby the ultimate sheet in the stack is presented in a partially upstanding position to facilitate grasping and removal thereof, and wherein there is provided a gravitational frictional engaging member for insuring such individual dispensing.

8 Claims, 7 Drawing Figures

Fig. 1.
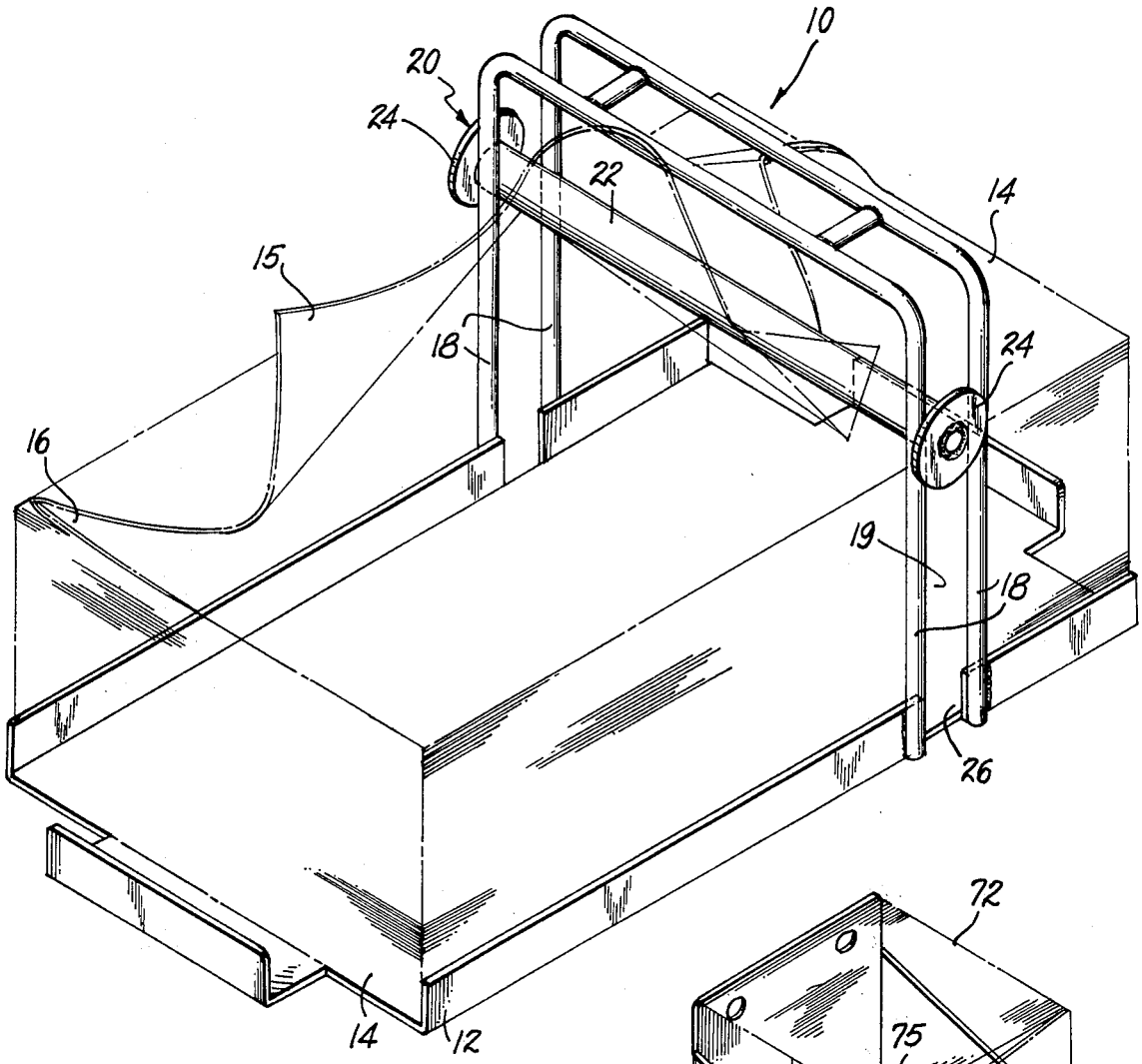
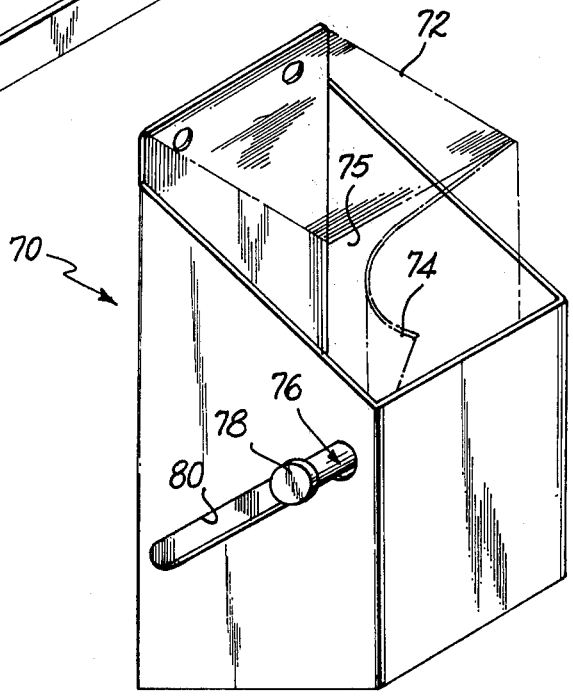
Fig. 7

METHOD AND APPARATUS FOR DISPENSING FLEXIBLE MATERIALS

BACKGROUND OF THE INVENTION

Field of the Invention

The present invention relates generally to methods and apparatus for the dispensing of individuals sheets of flexible material from an interleaved stack of folded sheets and, more especially, to the dispensing of paper products wherein there is provided a "pop-up" feature.

Description of the Prior Art

Numerous approaches have been developed for the individual dispensing of flexible sheet material from an interleaved folded stack thereof. A major endeavor has been to provide a "pop-up" feature in such dispensing means and methods to facilitate ease of dispensing. Many of these attempts have been of but limited success in providing either a simple method or in achieving the successful dispensing of a single sheet.

A particular problem which has been identified in the dispensing of flexible sheet material, and notably paper materials, with a "pop-up" feature is the tendency for chaining which results in the dispensing of a plurality of sheets from a folded stack thereof. This chaining problem has generally been attributed to excessive frictional forces between the faces of adjacent or successive sheets in the stack relative to the required force for dispensing. To overcome, or at least partially obviate, these frictional forces between successive sheets, there have been provided various methods to exert counteractive frictional forces. One such method resides in providing a floating follower having an aperture formed therein through which the sheets must be drawn for dispensing. The aperture is precisely formed in order to provide sufficient frictional force to overcome that between successive sheets and capture the leading edge of the next-subsequent sheet and present same in a partially upstanding position. This approach has not been entirely successful.

Another recent attempt to overcome the frictional engagement between successive sheets has been the provision of a slitted flexible restrainer integral with the dispensing opening of the container. This restrainer is deformable and similarly captures the next successive or penultimate sheet in the interfolded stack from which the sheets are removed. Again, however, this approach has not been entirely successful and suffers the same basic drawback of increased cost in the need to provide additional components within the packaging structure.

The problems encountered in dispensing these paper products have also been compounded with the recent emergence of moistened towels and the like. In dispensing these moistened paper products, frictional forces between successive sheets are enhanced by the moisture content thereof and, thus, dispensing means and methods have become quite complex where it is desired to provide a "pop-up" feature.

Another significant problem encountered in the prior art has been the inability to provide a dispensing apparatus which is reusable. As most of the prior art approaches have incorporated some variety of flexibly deformable member to capture successive sheets during the dispensing operations, these approaches have not been able to successfully provide means and methods which permit extended use of the container structure as the efficiency of these flexible and deformable members diminishes rapidly with prolonged use. With the present trend toward providing the consumer with a reusable product as a method of conservation, yet further drawbacks to approaches heretofore employed become apparent.

Accordingly, the need exists to provide a reusable container for the successful dispensing of individual sheets of flexible materials, preferably paper materials, in either a wet or dry state, and further provide a desirable "pop-up" feature. Additionally, the need exists to accomplish this objective in a simple, yet highly efficient and economical manner.

SUMMARY OF THE INVENTION

In accordance with the noted deficiencies of the prior art, it is the major object of the present invention to provide a simple, yet highly efficient and economical, container for the dispensing of individual sheets of flexible materials from an interleaved stack of folded sheets where the ultimate sheet in the stack is presented in a partially upstanding position for ease of grasping and dispensing.

It is also an object of the present invention to provide a method and means for the "pop-up" dispensing of paper products, whether wet or dry.

It is yet a further object of the present invention to provide a method and means for insuring the successful dispensing of a single sheet of flexible material without encountering chaining from a stack of folded sheets.

In accordance with the objects and advantages of the present invention, it has been determined that the dispensing of sheet materials, and especially paper products, from an interleaved stack of folded sheets, whereby the ultimate sheet in the stack is presented in a partially upstanding position to facilitate grasping and dispensing thereof, may be provided by contacting the upper face of the ultimate sheet in the stack intermediately along the length thereof with a gravitational frictional engaging member. As the ultimate sheet is dispensed, it passes beneath the frictional engaging member until the upper face of that sheet has been sufficiently withdrawn to present the upper face of the penultimate sheet in the stack. At that point, frictional engagement with the upper face of the penultimate sheet restrains same sufficiently to permit the interleaved faces of the ultimate and penultimate sheets to slide past one another. The force provided by the gravitational frictional engaging member is sufficient to overcome the frictional forces between successive sheets but insufficient to completely restrain gross motion of the penultimate sheet. Thus, as the ultimate sheet is withdrawn from the stack it partially withdraws the penultimate sheet into an upstanding position. The frictional engagement with the upper face of the penultimate sheet is constantly maintained after withdrawal of the ultimate sheet and, accordingly, there is provided a "pop-up" feature without chaining.

Yet further objects and advantages of the present invention will become apparent to the skilled artisan upon examination of the detailed description of the invention, taken in conjunction with figures of drawing wherein:

BRIEF DESCRIPTION OF THE DRAWINGS

FIG. 1 is an isometric view of a dispensing apparatus of the present invention with the ultimate flexible sheet shown in partially upstanding position;

DETAILED DESCRIPTION OF THE INVENTION

Figure 2:
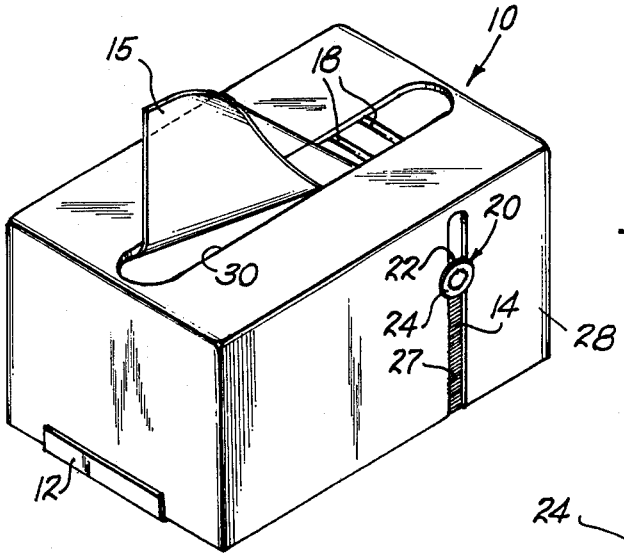
FIG. 2 is an isometric view of a dispensing apparatus of the present invention, similar to FIG. 1, on a smaller scale, showing a cover assembly therefor.

The present invention relates generally to the dispensing of flexible sheet material from an interleaved stack of folded, individual sheets thereof. More especially, the invention relates to the dispensing of interleaved paper products and provides a "pop-up" feature in a simple, yet highly efficient and economical manner. Additionally, the method and apparatus of the present invention may be employed in the dispensing of either wet or dry paper products with equal efficiency. In order to more fully describe the various objects and advantages of the present invention, the following detailed description will be given in terms of various preferred embodiments, the same intended to be illustrative and in no manner limitative.

The dispenser of the present invention, generally designated as 10 in FIG. 1, is comprised of a base member 12 upon which freely rests a stack 14 of interleaved, folded paper sheets. A preferred type of interleaved stack is that marketed under the name "SINGLEFOLD—BRAND 170," by Scott Paper Company, Philadelphia, Pa. As shown in FIG. 1, the ultimate sheet 15 is in partially upstanding relationship and is partially engaged with penultimate sheet 16 at opposing faces thereof. Affixed to base 12 is a pair of substantially U-shaped rods 18 which define a channel 19 therebetween. A gravitational frictional engaging member 20 is freely disposed within channel 19, as will be described more fully herein below. Engagement member 20 is comprised of a central portion 22, which terminates at enlarged stops 24 to prevent lateral displacement of member 20 only in a plane transverse to the stack of paper towels or sheets 14. A slot is formed in base 12 to allow contact between member 20 and the paper sheets as the stack is depleted during the dispensing operation.

Gravitational frictional engagement member 20 is freely rotatably disposed within channel 19 and provides a downward force on the stack of paper sheets 14. This downward force is directly applied to the upper face of the ultimate sheet 15 between dispensing operations and is sufficient to maintain the partially upstanding position of sheet 15. During the dispensing operation, sheet 15 is withdrawn by an outward and/or upward pulling force shown generally by the arrow in FIG. 3. During this operation, the upper face of sheet 15 slides beneath the central portion 22 of member 20 and the frictional force between sheets 15 and 16 causes displacement of both sheets from a corner 17, as best viewed in FIG. 3. Continued pulling on sheet 15 will eventually cause the entirety of the upper face thereof to pass beneath central portion 22 of engagement member 20, whereupon the upper face of sheet 16 becomes frictionally engaged therewith. At this point, interfrictional forces between sheets 15 and 16 are considerably less than the force exerted upon the upper face of sheet 16 by member 20. Accordingly, continued application of dispensing force easily withdraws sheet 15 from stack 14 and only partially displaces sheet 16 against the frictional restriction force applied by member 20. Consequently, as sheet 15 completely disengages from sheet 16, the latter remains in a partially upstanding position ready for the next dispensing operation. Due to the interleaved nature of the sheets in stack 14, the corner 17 which is caused to undergo gross movement will alternate between dispensing operations. Thus, the ultimate sheet in stack 14 will assume a partially upstanding position from alternate sides of the stack between successive dispensing operations. However, with cover 28 affixed as shown in FIG. 2, the ultimate sheet will be directed generally through aperture 30.

Figure 6:
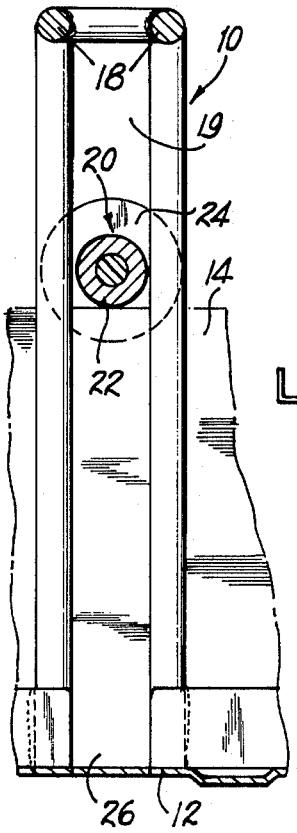
FIG. 6 is an enlarged fragmentary vertical sectional view, taken on the staggered section line 6—6 of FIG. 3; and, FIG. 7 is an isometric view of an alternate embodiment of the present invention.
Figure 4:
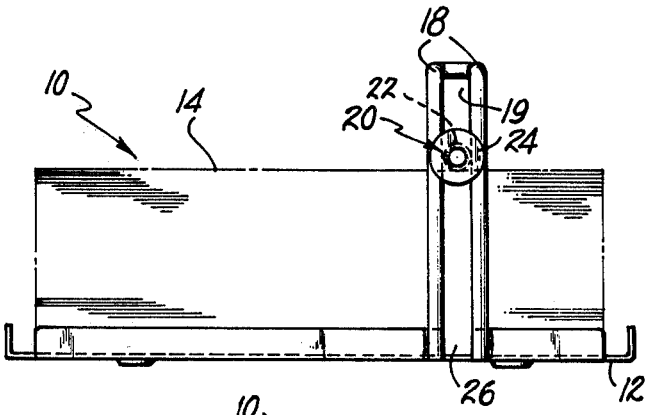
FIG. 4 is a side elevational view of the dispenser of FIG. 3.
Figure 5:
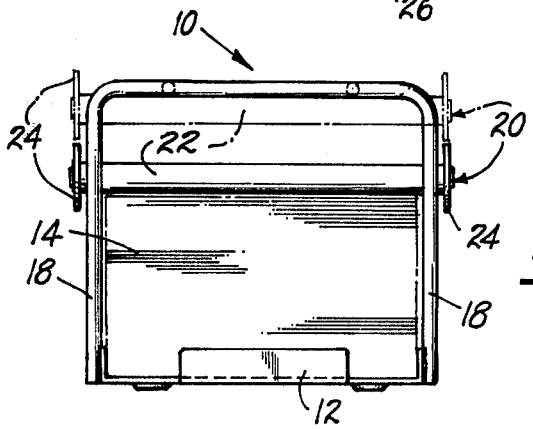
FIG. 5 is an end view of the dispenser of FIG. 4 as viewed from the left side thereof.

FIGS. 4, 5 and 6 illustrate the manner in which frictional engagement member 20 rides within channel member 19 during the dispensing of sheets from stack 14. Member 20 continuously exerts downward force on stack 14 due to gravitational forces and will gradually move downwardly within channel 19 as the stack 14 is depleted. Slot 26, as best viewed in FIG. 6, is provided in base member 12 in order to insure dispensing when only a few sheets remain in the stack.

Figure 3:
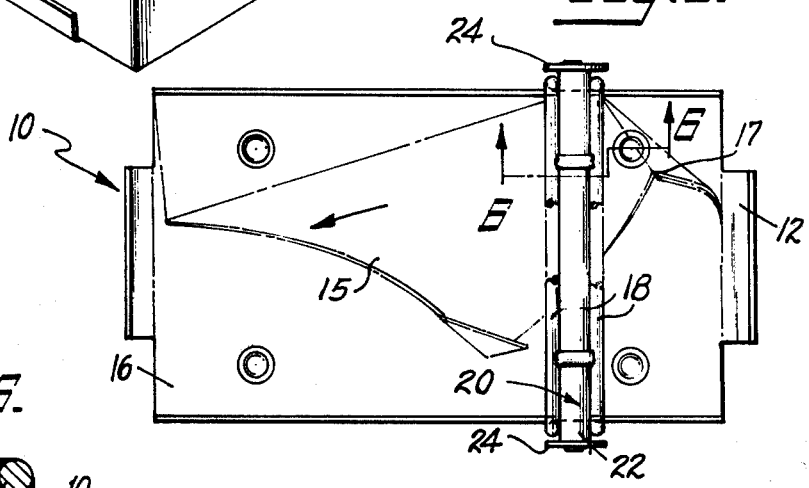
FIG. 3 is an enlarged plan view of the dispenser of FIG. 1.

Optionally, when employing the embodiment of FIG. 2 wherein a cover is provided, the channel 19 may be conveniently provided by a pair of slots 27 formed in opposite sides of cover 28. Otherwise, the apparatus is identical with that described above. Optional also, base 12 may be provided with a suitable fastener for permanently affixing same in any convenient location. It is also envisioned that the channel 19 may be formed substantially oblique to the plane of base member 12 whereby the dispenser 10 may be mounted in angular relationship to a table top or wall, provided the angle of channel 19 is sufficient to permit the frictional engagement member 20 to exert sufficient force on the stack of sheets 14.

Along similar lines, the alternate embodiment of FIG. 7 illustrates a dispenser of the present invention adapted for compact wall mounting. This embodiment is comprised of a container housing 70 having a stack 72 of interleaved sheets, similar to those described above, disposed therein. The ultimate sheet 74 is in partially upstanding position for ease of grasping during the next dispensing operation and is in frictional engagement with penultimate sheet 75.

A frictional engagement member 76 having stops 78 is free to move within slot 80 formed in housing 70. As shown, slot 80 is oblique with respect to the transverse plane of stack 72 whereby frictional engagement member 76 maintains constant contact with the exposed face of the ultimate sheet in stack 72. Otherwise, dispensing is identical with the sequence of operations described above.

While frictional engagement member 20 has been described and illustrated as having a central cylindrical portion 22, it is not essential that this geometry be employed to realize the various objects and advantages of the present invention. Provided member 20 exerts sufficient downward force to maintain the ultimate sheet of stack 14 in partially upstanding position, and insufficient force to interfere with the withdrawal of the ultimate sheet upon dispensing, the absolute shape is not critical. Thus, central portion 22 might be square, rectangular, ovate, etc.

While the invention has now been described in terms of various preferred embodiments, the skilled artisan will appreciate that yet other omissions, changes, substitutions, and modifications may be made without departing from the spirit thereof. Accordingly, it is intended that the invention be limited solely by the scope of the following claims.

What is claimed is:

1. Apparatus for dispensing individual sheets of flexible materials from an interleaved stack of folded sheets whereby the ultimate sheet in said stack is presented in a partially upstanding position to facilitate grasping and dispensing thereof, said apparatus comprising:

a. base means for supporting an interleaved stack of folded sheets;

b. gravitational frictional engaging means for contacting the exposed face of the ultimate sheet in said stack intermediately along the length thereof permitting withdrawal of said ultimate sheet and for constantly frictionally engaging the exposed face of the penultimate sheet in said stack and restraining same once the exposed face of said ultimate sheet has passed whereby said penultimate sheet is then presented in partially upstanding position beyond contact with said frictional engaging means defining a static dispensing plane intersected by said engaging means. 2. The apparatus of claim 1, wherein said frictional engaging means comprises a cylindrical rod rotatably disposed within said guide means, said rod terminating in stop means of enlarged cross section for maintaining said rod within said guide means.

3. The apparatus of claim 2, wherein said guide means are comprised of a pair of inverted, substantially "U-shaped" members attached to said base means, said members being in spaced relationship defining a channel for receiving said rod.

4. The apparatus of claim 3, further comprising a cover member for surrounding said base means and folded sheets and having an aperture therein through which said sheets are dispensed.

5. The apparatus of claim 4, wherein said sheets are paper sheets.

6. The apparatus of claim 2, further comprising a cover member for attachment to said base member, and having an aperture formed therein through which said sheets are dispensed, and wherein said guide means are comprised of transverse slits in opposite sides of said cover for receiving said rod.

7. Method for dispensing individual sheets of flexible materials from an interleaved stack of folded sheets whereby the ultimate sheet in said stack is presented in a partially upstanding position to facilitate grasping and dispensing thereof, said method comprising the steps of:

a. supporting an interleaved stack of folded sheets on a base member;

b. contacting the exposed face of the ultimate sheet in said stack with gravitational frictional engaging means intermediately along the length of said sheet, said ultimate sheet being in a partially upstanding position defining a static dispensing plane intersected by said engaging means;

c. applying a dispensing force to said ultimate sheet whereby the exposed face of said sheet frictionally passes beneath said engaging means, exposing the face of the penultimate sheet in said stack to said engaging means in a partially upstanding position; and, d. maintaining constant frictional engagement with the exposed face of said penultimate sheet until a subsequent dispensing operation.

8. The apparatus of claim 2, wherein said base member is comprised of a container having a bottom wall and upstanding side walls for supporting said stack of folded sheets, and wherein said guide means are comprised of a pair of slits in opposing side walls, said slits being formed oblique to the plane of said stack of folded sheets.

* * * * *

UNITED STATES PATENT OFFICE

CERTIFICATE OF CORRECTION

Patent No. 4,046,281 Dated September 6, 1977

Inventor(s) Henry C. Voegeli

It is certified that error appears in the above-identified patent and that said Letters Patent are hereby corrected as shown below:

On the title page, delete the Figure of Drawing and replace the same with the Figure shown on the attached sheet.

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*

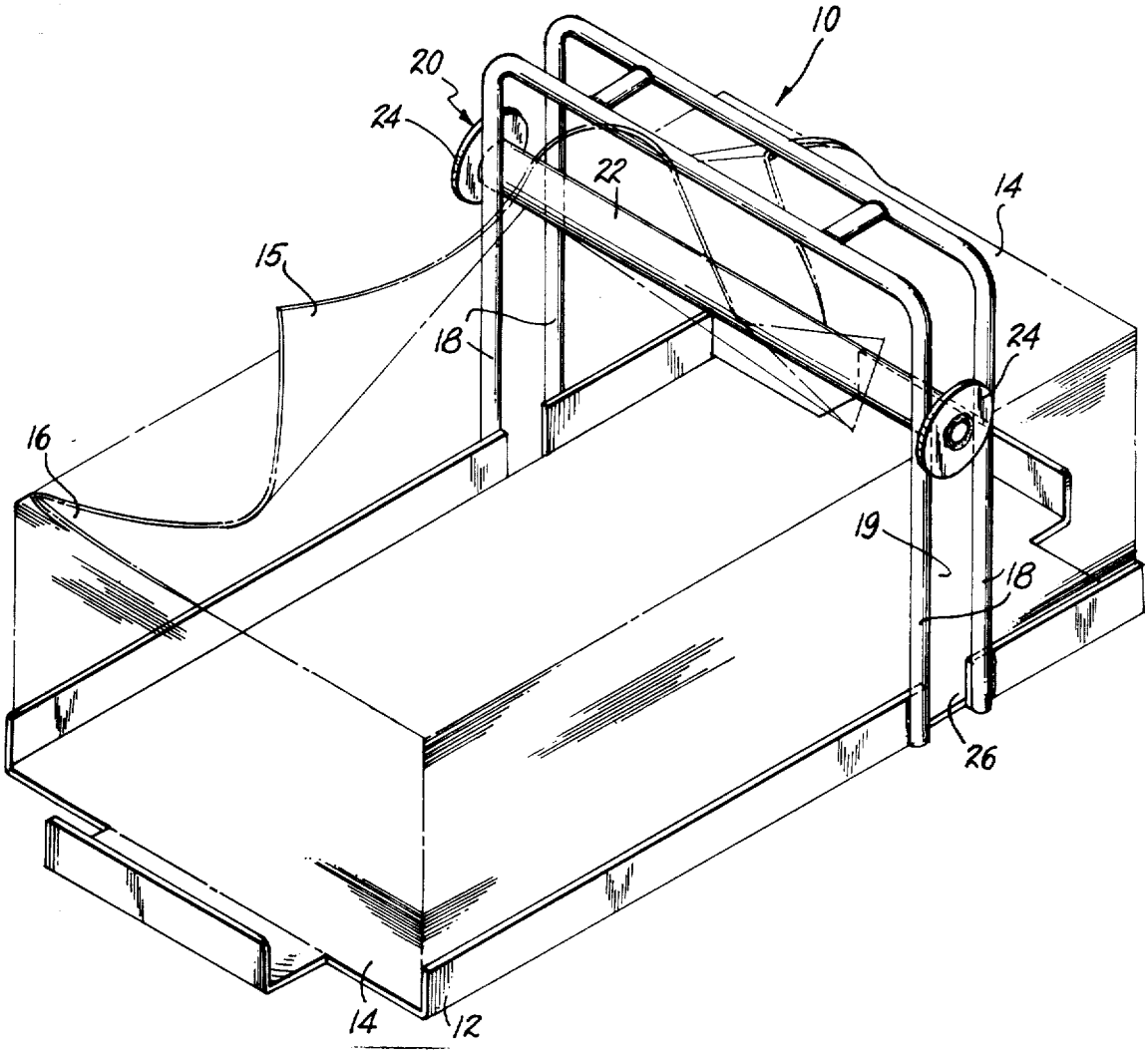
10
20
24
22
14
15
18
24
16
19
18
26
14
12